US005882791A

United States Patent [19]

van der Werff et al.

[11] Patent Number: 5,882,791

[45] Date of Patent: Mar. 16, 1999

[54] PARA-AROMATIC POLYAMIDE YARN HAVING LOW FILAMENT LINEAR DENSITY AND A PROCESS FOR MANUFACTURING SAME

[75] Inventors: Harm van der Werff, Ede; Jozef Johannes Maria Baltussen, Nijmegen; Mattheus Harmannes Hofman, Arnhem, all of Netherlands

[73] Assignee: Akzo Nobel N.V., Arnhem, Netherlands

[21] Appl. No.: 910,446

[22] Filed: Aug. 5, 1997

[30] Foreign Application Priority Data

Aug. 9, 1996 [NL] Netherlands ..... 1003772

[51] Int. Cl.[6] ..... D02G 3/00

[52] U.S. Cl. ..... 428/364; 428/395

[58] Field of Search ..... 428/364, 395

[56] References Cited

U.S. PATENT DOCUMENTS

| | | | |
|---|---|---|---|
| 3,767,756 | 10/1973 | Blades et al. | 264/184 |
| 4,308,374 | 12/1981 | Volbracht et al. | 528/336 |
| 4,850,050 | 7/1989 | Droste et al. | 2/2.5 |

FOREIGN PATENT DOCUMENTS

| | | | |
|---|---|---|---|
| 021 484 | 1/1981 | European Pat. Off. | D01F 6/60 |
| 241 681 | 10/1987 | European Pat. Off. | F41H 1/02 |
| 609 946 | 8/1994 | European Pat. Off. | D01F 6/60 |
| 617 044 | 9/1994 | European Pat. Off. | C07F 17/00 |
| WO 92/15733 | 9/1992 | WIPO | D01F 6/60 |
| WO 95/21883 | 8/1995 | WIPO | C08G 69/32 |
| WO 96/34732 | 11/1996 | WIPO | B29C 47/78 |

OTHER PUBLICATIONS

Baltussen, "Delft Technical University", *Tensile deformation of polymer fibers,* p. 8 (1996).

Jawad, et al., "Journal of Materials Science", *The transverse compression of oriented nylon and polyethylene extrudates,* 13, pp. 1381–1387 (1978).

Kiya–Oglu, et al., "VNIIPV, Mytishchi, Translated from Khimicheskie Volokna", *Effect of Spinning Conditions on the Stationary Regime Region in Stretching a Jet of a Solution of Poly–P–Phenyleneterephthalamide in an Air Gap,* 2, pp. 86–89 (1993).

Northolt, et al., "Polymer", *Elastic extensiosn of an oriented crystalline fibre,* 26, pp. 310–316 (1985).

International Search Report dated Aug. 9, 1996.

*Primary Examiner*—Newton Edwards

*Attorney, Agent, or Firm*—Louis A. Morris

[57] ABSTRACT

A p-aramid microfilament yarn and a process for manufacturing the same. In the p-aramid yarn, which has a yarn linear density of at least 300 dtex, comprising a bundle of filaments with a linear density of less than 0.8 dtex, the g value is higher than 2.5 GPa, the elongation (EAB) is higher than 3.4%, and the L002 value is higher than 350 Å. More particularly, the filament linear density is 0.3 to 0.8. The yarn according to the invention has surprisingly favorable properties, such as a high internal shear modulus. The invention also pertains to a process for manufacturing such a microfilament yarn in which p-aramid is subjected to an air gap-wet spinning process of the known type, in which the draw ratio in the air gap combined with the diameter of the capillaries through which the polymer is extruded ensures that microfilament yarn having the desired properties is obtained.

8 Claims, 2 Drawing Sheets

Ultra-low tex sequence + Reference materials

Ultra-low tex sequence + Reference materials

PARA-AROMATIC POLYAMIDE YARN HAVING LOW FILAMENT LINEAR DENSITY AND A PROCESS FOR MANUFACTURING SAME

BACKGROUND OF THE INVENTION

1. Field of the Invention

The invention pertains to a a para-aromatic polyamide filament yarn.

2. Description of the Prior Art

Para-aromatic polyamide filament yarn is known from EP 609 946 (van der Pol), which discloses p-aramid yarn where the filaments may have a linear density of 0.8 to 1.3 dtex, the example given being 1.1 dtex. Van der Pol teaches that yarns characterized by a lower filament linear density than that of standard yarn have several advantages. For instance, this known yarn has excellent properties for use as a reinforcing fiber in rubber articles which can be subjected to mechanical load. However, there is still room for substantial improvement. For instance, EP 609 946 fails to provide an aromatic polyamide yarn which can be put to advantageous use in a wide range of applications. Thus the search is on for p-aramid yarn having a high internal shear modulus for use, int. al., as antiballistic yarn, but also for use as reinforcing yarn in optical cables, and for fabrics to be utilized without a matrix or with matrices other than rubber. This so-called g-value constitutes a proper standard for a number of properties which are relevant to the yarn all at the same time, viz. drawing modulus, torque modulus, and axial compression strength. Yarn such as described by Van der Pol has a comparatively low g-value of about 2.2 GPa. It should be noted that while this value can be increased. Other publications also disclose yarns with filaments having a lower linear density than standard yarn.

For instance, JP-Hei-6-2216 (Teijin) describes PPTA yarns having a filament linear density of 0.17 to 0.75 denier (converted: 0.19 to 0.83 dtex). It is stated that these yarns especially possess favorable abrasion resistance. However, the described yarns are less suited to be used in actual practice on account of their low linear density thereof. Among other things, this low linear density means that the yarn cannot be usefully employed as such, but only in an assembled form. This needless assembling of yarns is an economically unattractive additional step and, moreover, involves the risk that the mechanical properties of the yarn finally assembled will have decreased proportionally. The described process, which typically produces bundles of 133 and maximally 300 filaments having a yarn linear density of at the most 100 denier (110 dtex), does not readily allow thicker yarns to be produced. In the case of a thicker bundle use will have to be made of a smaller air gap if the pitch/air gap ratio required according to Teijin is to be maintained. Coagulating a thick bundle also is more difficult when using this process. Furthermore, Teijin has the drawback that the obtained yarn has an extremely low crystallite length (L002 value). Besides, Teijin when spinning p-aramid from solution does so with a very low polymer content in the spinning solution and a very high acid concentration in the spinning bath, as a result of which the described yarns inherently lack the optimum properties of the PPTA. In addition, the high acid concentration in the bath leads to sticking of filaments, particularly in the case of thicker bundles. Lower acid concentrations are not possible in the Teijin process, because low concentrations lead to high yarn cutting. Besides the aforementioned low L002 value, yarns made as specified by Teijin have an objectionably high para-crystallinity (indicating a highly disturbed crystal structure). Another drawback to the yarns described by Teijin is their low density.

*Chimitsjeskie Volokna*, No.2, pp 17–19, March–April 1993 (Kiya-Oglu et al.) describes the manufacturing of PPTA yarns using an air gap-wet spinning process with a far greater degree of drawing in the air gap than is customary. It is stated that this can be done only when the temperature in the air gap is greatly reduced. For instance, at −35° C. there was 65× drawing. Although the publication of Kiya-Oglu et al. has no bearing on yarns having a low filament linear density, it is self-evident that said linear density will be reduced by the drawing. Thus the yarn drawn up to 65× is composed of filaments having a linear density of 0.26 dtex. The yarns described here do not have the yarn linear density desired in actual practice either (the number of filaments is restricted to 200). Moreover, the low temperature in the air gap required according to this publication is highly unattractive from a practical and economical point of view. Nor does this process make it possible to produce thicker bundles. For, when the number of filaments is higher, it proves impossible to create a homogeneous situation as regards the temperature and the drawing characteristics in the air gap, which has a detrimental effect on the product properties. Also, blowing a larger number of filaments involves practical problems.

The use of yarns having a lower than standard linear density for ballistic applications is known in itself. For instance, EP 241 681 (Droste) teaches a bullet resistant vest in which use is made of a fabric of aramid yarn with a filament linear density of less than 1.5 dtex, the example given being 1.12 dtex. In actual practice, yarn with a filament linear density of 0.93 dtex has also become popular.

SUMMARY OF THE INVENTION

It is a broad objective of our invention to provide aramid yarns which have the advantages of a low filament linear density, are suitable for use in ballistic and other applications, can be manufactured in an attractive manner, and in addition have a high internal shear modulus.

In brief summary, our invention comprises a non-assembled para-aromatic polyamide filament yarn having a yarn linear density of at least 300 dtex. The yarn comprises a bundle of filaments with a linear density of less than 0.8 dtex, a g value higher than 2.5 GPa, an elongation (EAB) higher than 3.4%, and a L002 value higher than 350 Å.

Another aspect of our invention comprises a process for manufacturing a para-aromatic filament yarn having a filament linear density of less than 0.8 dtex in which a p-aramid spinning solution in concentrated sulfuric acid with a polymer content of 17 to 20.5% is extruded through a spinneret provided with spinning orifices having diameters less than 55 $\mu$m. The extruded p-aramid is passed through an air gap with a draw ratio in the air gap of from 6 to 12 and collected in an aqueous coagulation bath having a solvent concentration <30%.

DETAILED DESCRIPTION OF THE INVENTION

Figure 1:
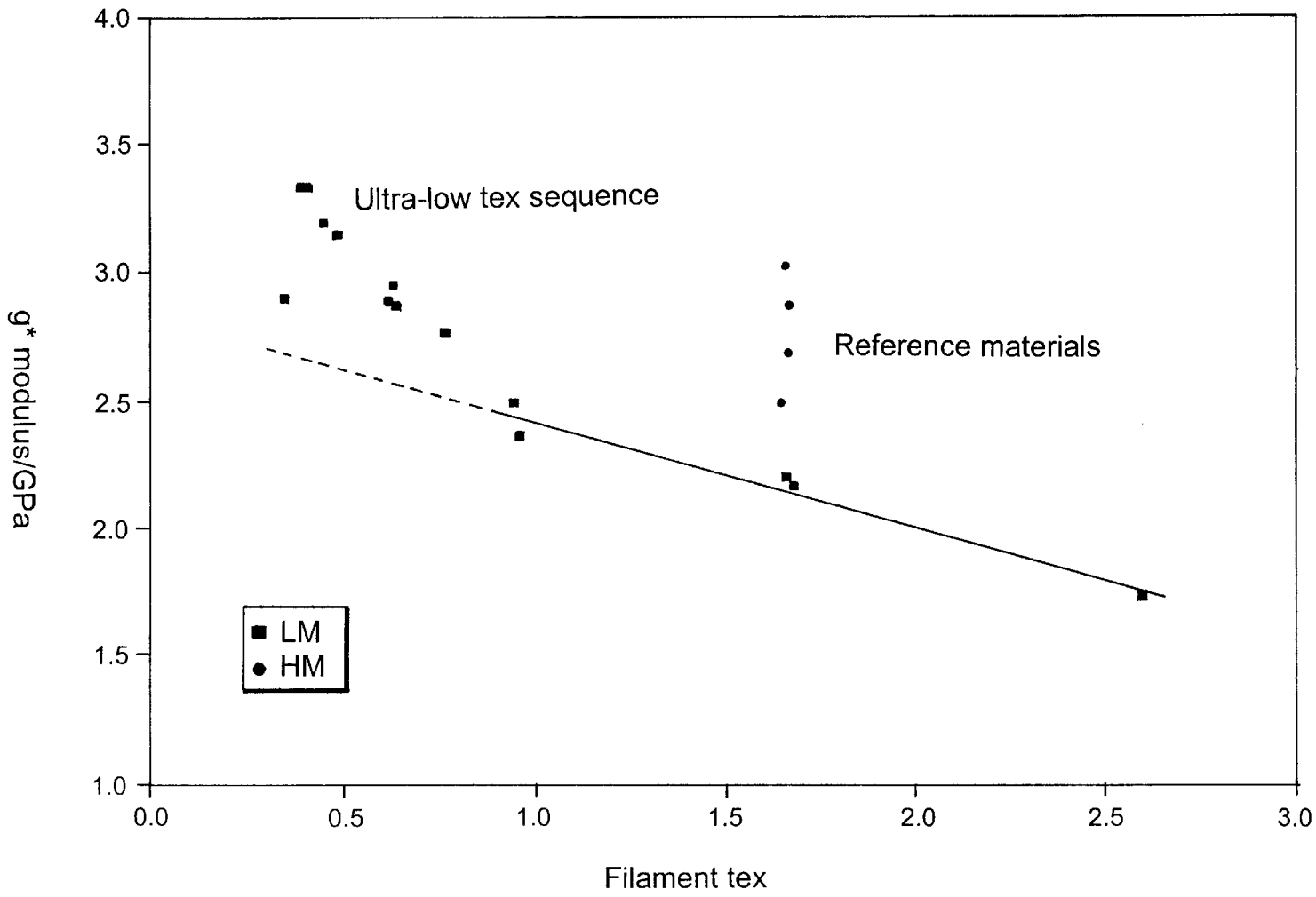

The yarns according to the invention, referred to hereinafter as microfilament yarns, have a surprisingly increased internal shear modulus: where otherwise comparable, known PPTA yarns such as described by Van der Pol and Droste have a g-value of 2.2 GPa or less, in the case of the yarns according to the invention there is a surprising improvement and values up to even higher than 3.3 GPa are found. Preferably, the yarn g-value is higher than 2.6 GPa, and more preferably higher than 2.7 GPa. Values higher than 3.0 GPa are possible. Preferably, the yarns according to the invention have a filament linear density of more than 0.3 dtex and less than 0.8 dtex. An extra augmented internal shear modulus is found in yarns having a filament linear density of about 0.35 to 0.6 dtex. Preferred elongation at break (EAB) is higher than 3.5%. L002 values are preferably higher than 375 Å, and more preferably higher than 400 Å, whereas para-crystallinity is less than 2.15, and preferably less than 2.10.

The term "non-assembled para-aromatic polyamide filament yarn" means that the filaments of the yarn are produced with one spinneret. Assembled yarns can be produced during the spinning process or thereafter, for instance, by assembling the filaments from different spinnerets, or by assembling different bobbins with microfilament yarns.

By para-aromatic polyamide (p-aramid) is meant any polyamide of which the polymeric main chain is composed wholly or for the most part of aromatic nuclei, such as phenylene, biphenylene, biphenyl ether, naphthylene, and the like, which are interconnected wholly or for the most part via the para-position (1,4-phenylene) or a comparable position (e.g., 2,6-naphthylene). Preferably, the aromatic nuclei are phenylene groups, more preferably, the polymer is PPTA.

Para-aramids are known to the skilled person and need no further elucidation as such. PPTA can be prepared in a known manner by the reaction in an appropriate solvent (notably $CaCl_2$-containing N-methyl pyrrolidone) of stoichiometric amounts of para-phenylene diamine (PPD) and terephthalic acid dichloride (TDC). Suitable processes have been described in NL 157327 and WO 95/21883.

The invention pertains to filament yarns. As the skilled person will know, these are yarns which comprise a bundle of endless filaments, made by a spinning process in which a solution of the polymer to be spun is extruded through a spinneret plate or a spinneret containing a plurality of spinning orifices corresponding to the number of filaments. The filament yarn according to the invention preferably comprises at least 500 filaments, more particularly 1000 or more. More preferably, the number of filaments is 1500 to 3000. The yarn preferably is untwisted. To ensure reliable measurement of the mechanical properties, however, it is common knowledge that usually a twist is applied.

As was indicated above, it is of the essence to have a yarn linear density of about 300 dtex or higher. Preferably, the yarn linear density is at least 900 dtex, int. al., because of the maximum loop efficiency which can be achieved then. For an optimum combination of ready producibility and a proper reflection of the intrinsic properties of the polymer, the p-aramid yarn according to the invention more preferably has a yarn linear density of 600 to 1200 dtex, also on account of the fact that such a yarn is easy to weave. If so desired, the yarn according to the invention can be assembled to form a thicker yarn. While, as was indicated above, this is not preferred, it should be noted that generally yarns according to the invention do not require to be assembled more than a couple of times (say, doubled or tripled), which, needless to say, involves fewer drawbacks than pairing the ultra-low tex linear density yarns some dozens of times, as specified by the state of the art.

The spinnerets used to make the microfilament yarns according to the invention preferably have spinning orifices with a smaller diameter than the conventional 65 μm. More preferably, use is made of spinnerets of which the orifices (capillaries) have a diameter of less than 55 μm, or, preferably, less than 50 μm, for instance, 40 to 50 μm.

To manufacture filament yarns having the desired properties, during spinning use is made of an anisotropic solution of PPTA in concentrated sulfuric acid. The PPTA preferably has a relative viscosity, determined at 0.25 g/100 ml, of at least 3.5 and preferably more than 4.3.

The relative viscosity of the p-aramid is defined as the ratio of the times of outflow of a solution of the polymer (0.25 g p-aramid in 100 ml 96 wt. %-sulfuric acid) to the pure solvent measured in a capillary viscometer (Ubelohde) at 25° C.

At least 16 wt. %, and preferably about 17.0–20.5 wt. %, of the p-aramid is dissolved in an appropriate solvent such as concentrated sulfuric acid. When the polymer content in the solution is too low, a p-aramid with a too low L002 value is obtained, which is what happens in Teijin (JP-Hei-6-2216). This low L002 value indicates a small crystallite length in the direction of the fiber, so serving as a measure of the excellence of the ordering of the polymer molecules vis-à-vis the direction of the fiber axis. A high degree of ordering is important to relevant yarn properties such as creep, and L002 is held to be an important parameter for determining the yarn properties. Thus it was found that the lower the polymer content in the spinning solution is, the lower the values obtained for key properties such as breaking tenacity and modulus will be, indicating incomplete and insufficient utilization of the intrinsically favorable properties of the p-aramid polymer when using a spinning solution with a 15% polymer content. The invention pertains to p-aramid yarns of the type where the L002 value is 350 Å or higher. Preferably, the L002 value is higher than 375, or more preferably, higher than 400 Å.

For p-aramid in general, and PPTA in particular, anisotropic spinning solutions as such are known. They can be prepared in a known manner, e.g., with the aid of a freezing process as described in NL 7904495, which publication is to be considered incorporated by reference. According to the present invention, preferably use is made of an enhanced freezing process in which a mixing kneader is employed for melting the PPTA which was mixed with concentrated sulfuric acid via the freezing process, and mixing the whole further. In this process the polymer solution passes successively through at least a melting zone and a pressure build-up zone, with kneading as well as mixing taking place at least in the melting zone. The enhanced process indicated here is disclosed in non-prepublished patent application PCT/EP96/1731, which likewise is to be considered incorporated by reference.

The p-aramid spinning solution can be spun in a conventional air gap-wet spinning process. The temperature in the air gap generally is ambient (about 10° to 50° C. on account of the temperature of the spinning bath and the spinneret; there is no separate cooling or heating of the air gap). A too low temperature is to be avoided in such cases. In contrast with the extreme draw ratio in the air gap employed by Kiya-Oglu, the yarns according to the invention are only subjected to conventional drawing conditions (the drawing factor typically is in the range of 6 to 12). Air gap-wet spinning processes for p-aramid are known from, e.g., U.S. Pat. Nos. 3,767,756 and 4,320,081. It should be noted that the extruded yarns, after passing through the air gap, are coagulated in a spinning bath preferably containing water with or without dilute sulfuric acid (less than 30 wt. %). It is preferred not to exceed 20 wt. %, and preferably not to exceed 10% of acid in view of objectionable sticking of the filaments, and because it makes for an unfavorable process with more washing steps and a longer washing time. Moreover, high concentrations of acid in the bath give poor yarn properties.

To spin microfilaments successfully, the occurrence of "draw-resonance" has to be prevented. This phenomenon of sudden strong variations in filament thickness, and often filamentation as well, occurs, e.g., when a too high draw ratio is employed in the air gap. In the publication by Kiya-Oglu referred to above this drawback is overcome by intense cooling, which is attended with the aforementioned disadvantages. Within the framework of the present invention it has now been found that selecting a smaller spinning orifice diameter at a given draw ratio will lead to filaments having a correspondingly smaller linear density. It should be noted that, to be sure, the effect of smaller spinning orifices giving a smaller filament linear density is mentioned in JP Hei-6-2216, but that in this case comparatively much smaller diameters are required than according to the invention. For the sake of proper operation and an economically attractive spinning assembly, it is desirable in itself not to use capillaries which are too small. Teijin fails to teach anything about the draw ratio in the air gap. Calculations show this to be maximally 6.2. It is further noted that the size of the capillary as such does not teach the skilled person anything: for instance, it is also known to make p-aramid having a standard 1.68 dtex (1.5 den) filament linear density using smaller orifice diameters, cf. WO 92/15733 (DuPont).

For that reason the invention also pertains to a process for manufacturing p-aramid filament yarns having a filament linear density of less than 0.93 dtex in which a p-aramid spinning solution in concentrated sulfuric acid having a polymer content of at least 16 wt. %, preferably 17–20 wt. %, is passed through a spinneret provided with spinning orifices, the p-aramid extruded in this fashion is moved through an air gap (or some other inert space) and collected in an aqueous coagulation bath, said process being characterized in that the diameter of the spinning orifices is 55 $\mu$m or less, preferably 40 to 50 $\mu$m, and the draw ratio in the air gap is 6 to 12.

As indicated above, the microfilament yarns according to the invention have a surprisingly high internal shear modulus (g-value).

As is known from specialist literature, cf. Northolt et al. in *Polymer*, Vol. 26, 1985, p. 310 ("Polymer") and J. Baltussen's Ph.D. thesis entitled "Tensile Deformation of Polymer Fibers," Delft Technical University 1996, p. 8 ("Baltussen"), the g-value is a key parameter for the mechanical characterization of filament yarns.

The g-value can be determined by plotting the sonic compliance, $1/E_{son}$ against the chain orientation parameter measured for fibers with different degrees of orientation, either by means of X-ray diffraction, or from a curve representing the sonic compliance versus the rotational strain, $\epsilon_{rot}$. This strain component is defined as $$\epsilon_{rot} = \epsilon_f \simeq \frac{\sigma_f}{E_c} \tag{1}$$

where $E_c$ is the chain modulus (220 GPa for PpPTA), $\sigma_f$ the tensile stress, and $\epsilon_f$ the tensile strain of the fiber.

The sonic modulus, $E_{son}$, is the value of the modulus calculated from the density, $\rho$[kg/m$^3$], of the yam and the velocity of sound, v[m/s] by means of the equation:

$$E_{son} = \rho v^2 \tag{2}$$

This velocity is the propagation velocity of a short sonic pulse as measured according to the method described below.

The equation of the initial sonic modulus of an oriented fiber is given by:

$$\frac{1}{E_{son}} = \frac{1}{E_c} + \frac{\langle\sin^2\phi\rangle_E}{2g} \tag{3}$$

where $\langle\sin^2\phi\rangle_E$ is the orientation parameter averaged over the orientation distribution, f($\phi$), of the angle $\phi$ between the chain axis and the fiber axis, as defined in "Polymer."

For a well-oriented fiber the tensile strain, $\epsilon_f$ is given by:

$$\epsilon_f = \frac{\sigma_f}{E_c} + \frac{\langle\cos\phi\rangle - \langle\cos\phi_0\rangle}{\langle\cos\phi_0\rangle} \tag{4}$$

$$\text{or by } \epsilon_f = \frac{\sigma_f}{E_c} + \epsilon_{rot}$$

The first term in equation (4) is the contribution owing to the chain elongation, whereas the second term is the rotational strain, $\epsilon_{rot}$, being the contribution due to shear deformation, which results in a rotation of the chain axis towards the fiber axis, and thus, in contraction of the chain orientation distribution.

In the extended fiber theory as described in "Baltussen," a dependency of $\langle\sin^2\phi\rangle_E$ on $\sigma_f$ is taken into account, which results in an extra term $(1+\sigma_f/2g)$ in the denominator of the second term of equation (3):

$$\frac{1}{E_{son}} = \frac{1}{E_c} + \frac{\langle\sin^2\phi\rangle_E}{(2g + \sigma_f)} \tag{5}$$

For well oriented fibers $\epsilon_{rot}$ in equation (4) can be approximated by:

$$\epsilon_{rot} = \frac{\langle\cos\phi\rangle - \langle\cos\phi_0\rangle}{\langle\cos\phi_0\rangle} \approx \frac{1}{2}\left(\langle\sin^2\phi_0\rangle - \langle\sin^2\phi\rangle\right) \tag{6}$$

It is assumed that $\langle\sin^2\phi\rangle = \langle\sin^2\phi\rangle_E$.

Rearrangement of equation (5) yields:

$$\langle\sin^2\phi\rangle_E = (2g + \sigma_f)\left(\frac{1}{E_{son}} - \frac{1}{E_c}\right) \tag{7}$$

By measuring the sonic modulus and the tensile stress at two strain levels, viz. at 0.2% and 0.6% elongation, $\Delta\epsilon_{rot}$ can be calculated according to equation (1):

$$\Delta\epsilon_{rot} = \epsilon_2 - \epsilon_1 - \frac{(\sigma_2 - \sigma_1)}{E_c} \tag{8}$$

Using equations (6) and (7) $\Delta\epsilon_{rot}$ becomes:

$$\Delta\epsilon_{rot} \approx \frac{1}{2}\left[(2g + \sigma_1)\left(\frac{1}{E_1} - \frac{1}{E_c}\right) - (2g + \sigma_2)\left(\frac{1}{E_2} - \frac{1}{E_c}\right)\right] \tag{9}$$

From (8) and (9) the internal shear modulus, g, can be calculated according to:

$$g = \frac{\epsilon_2 - \epsilon_1 + \frac{3}{2}\cdot\frac{(\sigma_1 - \sigma_2)}{E_c} - \frac{1}{2}\cdot\left(\frac{\sigma_1}{E_1} - \frac{\sigma_2}{E_2}\right)}{\frac{1}{E_1} - \frac{1}{E_2}} \tag{10}$$

The internal shear modulus can be determined by the use of any suitable manually or automatically driven tensile testing machine equipped with a sonic device for measuring the velocity of sound during the extension of the fiber. The testing machine is equipped with a single movable clamp and a load cell. The gauge length of the bundle tested is 1800 mm or more. The machine also contains an extensometer system as specified in ASTM E83. The fixed and the variable error of the strain must not exceed $2.10^{-3}$%. The load cell indicates the load with a precision of 1% of the maximum indicated value of the test. The sonic pulse used for the determination of the velocity of sound has a distinct first peak. The rising edge of this first peak has a smooth bell shape with a rise time shorter than 25 ms. The sonic velocity is determined by measuring the propagation velocity of the rising edge of the first peak at 50% of the maximum peak height. The propagation velocity is measured over a distance of more than 1.0 meter. The velocity of sound is measured with an absolute precision of at least 5% and a relative precision of at least 1%.

The linear density of the fibers is measured by weighing a fiber sample with a length of 500 mm. To this end, a sample is cut from the fiber which is fixed on a flat surface under a low pretension of 5 mN/tex, using two markers which are fixed on the yarn with a spacing between them of 500±1 mm. The weight, M, of the sample expressed in milligrams, is measured by means of a balance with a precision better than 1%. The yarn count in dtex is calculated by: count=10*M/0.5.

The sonic modulus is determined by the following procedure:

The conditioned yam is clamped in the tensile testing machine equipped with the sonic device. The zero point of the strain for the sonic modulus strain test is determined at a pre-stress of about 10 mN/tex. The strain of the yarn is calculated with respect to the length of the yarn at the specified pre-stress. During the measurement the strain of the fiber is increased continuously by means of a motor driven clamp. Up to an elongation of 1% at least hundred data points of each of the physical quantities stress, strain, and velocity of sound are collected.

In a plot displaying the observed sonic modulus data versus the strain and the observed stress data versus the strain, the values of $E_1$ and $E_2$ and of $\sigma_1$ and $\sigma_2$ are read at $\epsilon_1$=0.2% elongation and at $\epsilon_2$=0.6% elongation. Subsequently, g is calculated using equation (10) and a value of $E_c$=220 GPa.

In the table the calculated values of the internal shear modulus, g, are given for a series of micro-count yarns. Data of yarns with a normal count are given too.

In the third section of the table data of high-modulus yarns are given.

| count | # filaments | fibercount/ dtex | g/GPa | $E_{son}$/GPa |
|---|---|---|---|---|
| | micro yarn count << 1.68 dtex: | | | |
| 293 | 750 | 0.39 | 3.33 | 131 |
| 619 | 1500 | 0.41 | 3.33 | 116 |
| 685 | 1500 | 0.46 | 3.19 | 131 |
| 735 | 1500 | 0.49 | 3.15 | 130 |
| 930 | 1500 | 0.62 | 2.89 | 124 |
| 950 | 1500 | 0.63 | 2.95 | 124 |
| 960 | 1500 | 0.64 | 2.87 | 121 |
| 1144 | 1500 | 0.76 | 2.77 | 120 |
| 945 | 1000 | 0.94 | 2.50 | 113 |
| 960 | 1000 | 0.96 | 2.37 | 108 |
| | yarns with normal and high yarn counts: | | | |
| 1110 | 666 | 1.67 | 2.21 | 95 |
| 1680 | 1000 | 1.68 | 2.17 | 97 |
| 2600 | 1000 | 2.60 | 1.74 | 68 |
| 2600 | 1000 | 2.60 | 1.73 | 78 |

-continued

| count | # filaments | fibercount/ dtex | g/GPa | $E_{son}$/GPa |
|---|---|---|---|---|
| | high modulus yarns (heat treated): | | | |
| 1110 | 666 | 1.67 | 2.69 | 119 |
| 1110 | 666 | 1.67 | 2.88 | 121 |
| 1660 | 1000 | 1.66 | 3.03 | 124 |
| 1650 | 1000 | 1.65 | 2.50 | 117 |

The microfilament yarns according to the invention not only have a surprisingly high g-value, they also possess excellent mechanical properties such as modulus, tensile strength, loop strength. A further unexpected advantage of the yarns according to the invention is their high cord strength and, in particular, their high cord efficiency. If so desired, the yarn may be subjected to the aforementioned known modulus-enhancing aftertreatment (hot drawing, e.g., on heated rolls). It should be noted that, surprisingly, without any hot aftertreatment the yarns according to the invention have a g-value which is comparable with that of the well-known HM yarns mentioned above, but with a higher elongation at break.

The invention will be elucidated further below with reference to the figures and the following, unlimitative examples.

FIG. 1 relates to the g-value. Shown are measuring points where the internal shearing stress as a result of the filament linear density was determined. The shown unbroken line indicates the relation found in the known yarns, the interrupted line is an extrapolation to the filament linear densities employed in the yarns according to the invention. It is clear that, according to the invention, a g-value is obtained which is a marked improvement over the state of the art (conventional, LM, yarns). The aforementioned HM yarns are also represented in the figure. On the x-axis the filament linear density (filament tex) is given in dtex. On the y-axis the g-value is indicated in GPa. The small squares indicated with "LM" are the measuring points of PPTA yarns made using a conventional spinning process, without any hot aftertreatment. Within the range of filament linear densities according to the invention these measuring points are indicated more precisely as "ultra-low tex range," within the range according to the prior art they are known as "reference material." The dots with the indication "HM" refer to measurements on high-modulus yarns subjected to hot wet drawing.

Figure 2:
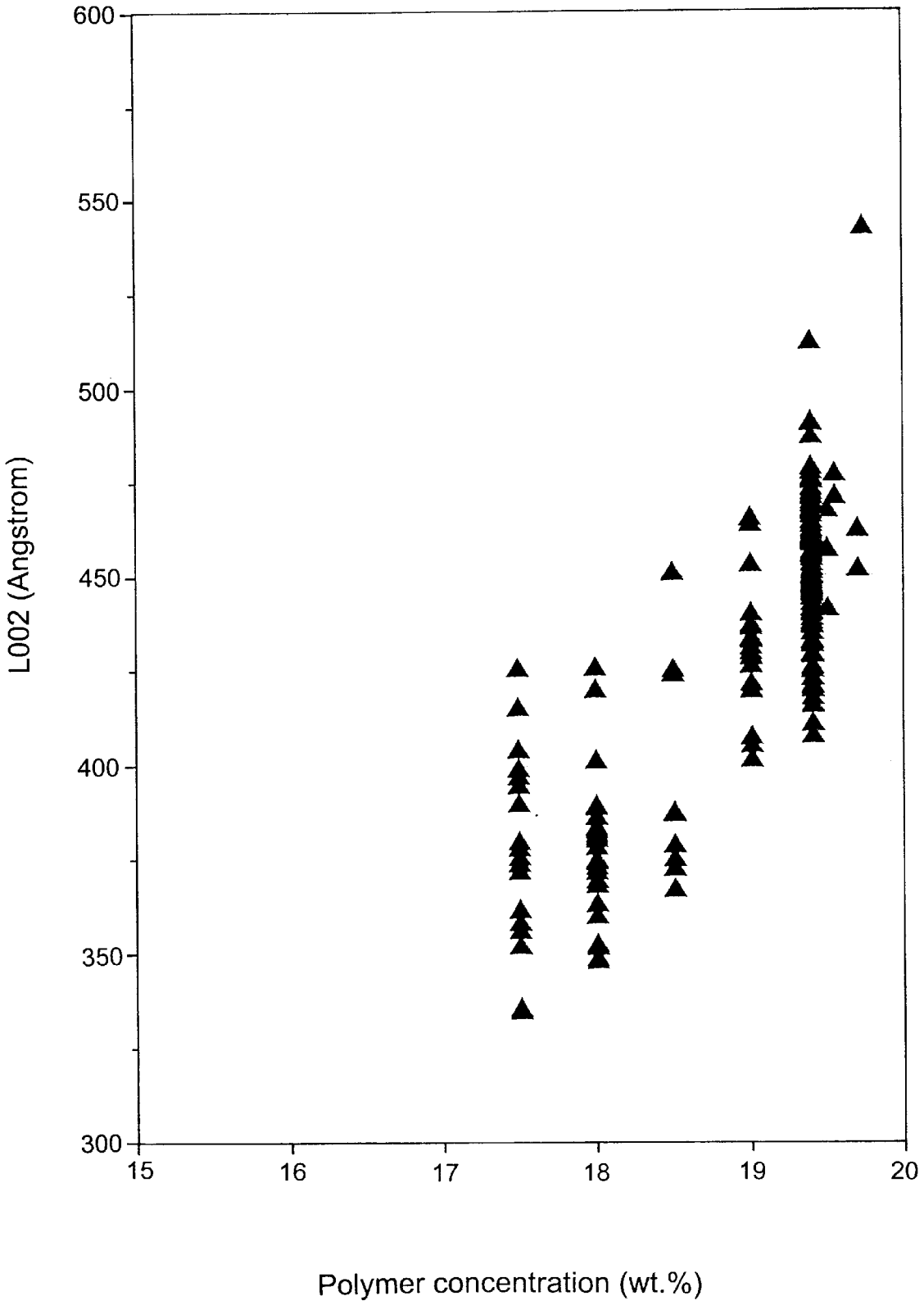

FIG. 2 relates to the relation between L002 and the polymer content in the spinning solution for PPTA yarns manufactured using a conventional air gap-wet spinning process. Shown is a large number of measuring points at different polymer concentrations. This large number stems from a very wide-ranging series of process conditions: spinning rate 250 to 500 m/min, acid concentration in the bath 5 to 20%, spinning bath temperature 5° to 35° C., drying temperature 120° to 210° C. On the x-axis the polymer content ("polymer concentration") is plotted in %, on the y-axis the L002 value is plotted in Å.

The value of L002 was calculated by means of X-ray diffraction. The yarn was wound onto a small, thin, flat frame in parallel arrangement. The meridional 002 reflection was scanned in transmission in a vertical X-ray diffractometer. The resulting diffraction profile was fitted with two bell-shaped lines, a comparatively broad one and a narrow one. From the halfwidth of the narrow line, $H_{obs}$, the value of L002 was calculated using the formula $$L002=1.5405/\sqrt{\{H^2_{obs}-0.01\cos(X_{01}/2)\}}$$

with $X_{01}$ as the diffraction angle of the meridional 002 reflection. For the description of the narrow line use was made of an ensemble of two Pearson VII components, taking into account the $\alpha_1$–$\alpha_2$ splitting as caused by the different wavelengths of the Cu $K\alpha_1$ and $K\alpha_2$ irradiation. In the formula given above $X_{01}$ equals the position of the peak due to the $\alpha_1$ component.

EXAMPLE 1

A PPTA solution in concentrated sulfuric acid (polymer concentration 19.4%) was spun into filament yarns of different linear densities and washed and dried in the conventional manner. The properties of these yarns are listed in Table 1. Spinning was by means of an air gap-wet spinning process common in itself, use being made of spinnerets having the correct capillary diameter and the correct draw ratio in the air gap. These relevant, varied parameters are also listed in Table 1. The spinning rate in all cases was 300 m/min, the spinning bath temperature was 5° C., the acid concentration in the bath was 5–10%. In a series of experiments (Examples 1a to 1f) yarns according to the invention with different filament linear densities were made. Also, yarns of a known type were made to serve as a comparative example (1g* and 1h*). The L002 value of the yarns from Example 1 ranged from 448 to 491 Å.

The effect of the filament linear density on the g-value is shown not only in the representation of Examples 1a to 1h* in Table 1 but also by FIG. 1. This figure shows, with reference to a series of experiments analogous to Example 1 and to well-known yarns, the relation between the filament linear density (x-axis) and the g-value (y-axis). The shown unbroken line represents the relation found for the known yarns, the interrupted line is an extrapolation to filament linear densities such as employed in the yarns according to the invention.

TABLE 1

| Ex. | D μm | L air gap | LD fil. (dtex) | # fil. | LD yarn (dtex) | g Gpa | BT mN/tex | EAB % | CM GPa | Loop BT mN/tex | Eff. % |
|---|---|---|---|---|---|---|---|---|---|---|---|
| 1a | 40 | 11.9 | 0.36 | 1500 | 534 | 2.86 | 2605 | 3.40 | 102.3 | nd | nd |
| 1b | 40 | 10.2 | 0.42 | 750 | 294.8 | 3.33 | 2380 | 3.03 | 108.8 | 1050 | 44 |
| 1b | 45 | 12.9 | 0.42 | 1500 | 631 | 3.33 | 2350 | 3.43 | 91.1 | nd | nd |
| 1c | 45 | 10.9 | 0.50 | 1500 | 728 | 3.15 | 2630 | 3.44 | 105.5 | 1210 | 46 |
| 1d | 45 | 8.5 | 0.64 | 1500 | 941 | 2.95 | 2570 | 3.56 | 96.5 | 1190 | 46 |
| 1e | 45 | 8.1 | 0.67 | 1500 | 937.2 | 2.89 | 2520 | 3.49 | 96.6 | 1180 | 47 |
| 1f | 45 | 6.7 | 0.81 | 1500 | 1144 | 2.77 | 2529 | 3.66 | 91.2 | 1240 | 49 |
| 1g* | 55 | 8.5 | 0.96 | 1000 | 946.4 | 2.5 | 2450 | 3.48 | 91.5 | 1040 | 42 |
| 1h* | 65 | 11.4 | 0.99 | 1000 | 948.4 | 2.37 | 2414 | 3.44 | 90.9 | 1020 | 42 |

nd not determined

The listed properties were determined as follows.

Linear density (LD)

In accordance with ASTM D 885 M-85; Standard Methods of Testing Tire Cords, Tire Cord Fabrics, and Industrial Filament Yarns Made From Man-Made Organic-Base Fibers.

Test conditions corresponding to option 1 of ASTM D1907-89; Standard Test Method for Yarn Number by the Skein Method. Number of measurements per bobbin: 3. The measurements were carried out on twisted yarn (Z90).

Mechanical yarn (tensile) properties

Measurement of breaking tenacity (BT), elongation at break (EAB), chord modulus (CM) in accordance with ASTM D885M-85; Standard Methods of Testing Tire Cords, Tire Cord Fabrics, and Industrial Filament Yarns Made From Man-Made Organic-Base Fibers.

Testing conditions: protective twist (yarn) 90 tpm; tensile testing machine: CRE-type, clamps: Instron 4D (cat. no. 2714-006); gauge length: 500 mm; drawing speed: 50 mm/min (10% of the gauge length); number of measurements per bobbin: 15 (3 series of 5 measurements); CM: interval 200–400 mN/tex.

Double loop strength

In accordance with ASTM 2256-90; Standard Test Method for Tensile Properties of Yarns by the Single-Strand Method, option C1.

EXAMPLE 2

In a known manner cords were made of yarns 1a, 1d, and 1g* from Example 1, of single as well as paired yarns. Considering that an increase in cord efficiency (percentage of ratio of breaking tenacity of cord to breaking tenacity of yarn) by several percent is deemed to be highly substantial, it is clear from the table that the yarns according to the invention give a surprising improvement.

TABLE 2

| Ex. | Yarn (ass.) | Cord strength (mN/tex) | Cord efficiency (%) | Cord structure |
|---|---|---|---|---|
| 2a | 1a (3×) | 2180 | 87.6 | ×2 330 × 330 |
| 2b | 1d (single) | 2117 | 83 | ×2 445/445 |
| 2c | 1d (2×) | 2078 | 82 | ×2 315/315 |
| 2d | 1g* (single) | 1993 | 80 | ×2 445/445 |
| 2e | 1g* (2×) | 1983 | 80 | ×2 315/315 |

EXAMPLE 3

The maximum shear stress in a filament at transverse fracture, $\tau_{max}$, was measured on a number of known yarns and a number of yarns analogous to those of Example 1 by means of a flattening test. $\tau_{max}$ is an important value indicating resistance to transverse load. The value was determined on three groups of p-aramid yarns:

(3a) standard-type yarns having a filament linear density of 1.72–1.76 dtex (3b) yarns having a filament linear density of 0.96–1.24 dtex (3c) microfilament yarns having a filament linear density of 0.42 to 0.81.

In this test a filament with a length of 30 mm was placed between two plane-parallel sheets. The sheets were pressed together with a constant velocity of force of 6.6 N/m/s, with the space between the sheets being registered. Following correction of the compliance of the measuring set-up, the transverse modulus $E_{11}$, and the critical line pressure $F_{crit}$ could be determined from the force-compression curve. The critical line pressure is the point on the force-compression curve where elastic deformation turns into plastic deformation. The transverse modulus was determined on the basis of the relation between the force (F) and the compression (u), the selected preconditions being the same as those given in Jawad and Ward in *Journal of Material Science,* 13, 1978, pp.1381–1387. The envisaged relation is:

$$u=-4F/\pi E_{11}\{\text{In}2-0.5+\arcsin(R/b)\},\ \text{with}\ b=\sqrt{\{4FR/\pi E_{11}\}}.$$

The results (statistically significant with 95% reliability) are listed in Table 3. It is very clear from this table that there is no significant difference between the known yarns 3a and 3b statistically speaking (this despite the smaller filament linear density of 3b). The maximum shear stress of the yarns according to the invention, 3c, is significantly different from, and substantially superior to, that of the known yarns.

TABLE 3

| Ex. | LD fil. (aver.) in dtex | $\tau_{max}$ in MPa |
|---|---|---|
| 3a | 1.72–1.76 (1.75) | 67.4 ± 5.8 |
| 3b | 0.96–1.24 (1.11) | 70.9 ± 9.7 |
| 3c | 0.42–0.81 (0.59) | 95.4 ± 10.2 |

EXAMPLE 4

To make PPTA filament yarns having a filament linear density ranging from standard to ultra-low, in all cases a PPTA solution in concentrated sulfuric acid (polymer concentration 19.4%) was subjected to an air gap-wet spinning process. In this process spinnerets with different orifice diameters were employed, as were different draw ratios in the air gap. The yarns were washed and dried in the conventional manner. The spinning rate in all cases was 300 m/min, the spinning bath temperature was 5° C. and 2° C., respectively, the acid concentration in the bath was 5 and 10%, respectively. The data and the results of these spinning experiments are listed in Table 4.

TABLE 4

| Ex. | D μm | L air gap (mm) | LD filament (dtex) | # filament | LD yarn (dtex) | BT (mN/tex) | EAB (%) | CM (GPa) |
|---|---|---|---|---|---|---|---|---|
| 5a | 65 | 6.5 | 1.74 | 1000 | 1736 | 2259 | 4.09 | 65 |
| 5b | 65 | 7.7 | 1.47 | 1000 | 1471 | 2292 | 4.05 | 67 |
| 5c | 65 | 9.4 | 1.21 | 1000 | 1210 | 2290 | 3.85 | 73 |
| 5d | 65 | 10.5 | 1.08 | 1000 | 1080 | 2317 | 3.84 | 75 |
| 5e | 65 | 11.9 | 0.95 | 1000 | 953 | 2298 | 3.7 | 80 |
| 5f | 65 | 13.7 | 0.83 | 1000 | 828 | 1420 | 2.71 | 73 |

TABLE 4-continued

| Ex. | D μm | L air gap (mm) | LD filament (dtex) | # filament | LD yarn (dtex) | BT (mN/tex) | EAB (%) | CM (GPa) |
|---|---|---|---|---|---|---|---|---|
| 5g | 55 | 4.7 | 1.72 | 1000 | 1719 | 2340 | 3.91 | 72.9 |
| 5h | 55 | 6.9 | 1.17 | 1000 | 1172 | 2430 | 3.71 | 83.5 |
| 5i | 55 | 9.0 | 0.90 | 1000 | 900 | 2450 | 3.51 | 91.3 |
| 5j | 55 | 9.4 | 0.86 | 1000 | 861 | 2470 | 3.51 | 93.5 |
| 5k | 50 | 4.0 | 1.68 | 1000 | 1681 | 2240 | 4.17 | 63 |
| 5l | 50 | 5.7 | 1.05 | 1000 | 1045 | 2370 | 3.97 | 75 |
| 5m | 50 | 8.5 | 0.79 | 1000 | 792 | 2396 | 3.79 | 83 |
| 5n | 45 | 7.0 | 0.77 | 1500 | 1162 | 2520 | 3.67 | 91.3 |
| 5o | 45 | 9.7 | 0.56 | 1500 | 944 | 2590 | 3.57 | 98.2 |
| 5p | 45 | 11.1 | 0.49 | 1500 | 735 | 2600 | 3.48 | 101.8 |
| 5q | 45 | 12.9 | 0.42 | 1500 | 631 | 2350 | 3.43 | 91.1 |
| 5r | 40 | 11.9 | 0.36 | 1500 | 534 | 2605 | 3.4 | 102.3 |

The table shows, int. al., that when use is made of a spinneret with a capillary diameter of 65 μm, it is not possible to manufacture a yarn having a filament linear density of less than 0.93 dtex while retaining favorable properties—cf. Example 5f, where the yarn's strength, elongation, and modulus have decreased significantly as compared with Example 5e. Such a yarn can be made when use is made of a 55 μm spinneret and a draw ratio in the air gap of 9.4 (Example 5j), and the same holds for spinnerets having a diameter of less than 50 μm. Very good yarns are made using 45 μm and 40 μm spinnerets (Examples 5n to 5r).

We claim:

1. A non-assembled para-aromatic polyamide filament yarn having a yarn linear density of at least 300 dtex, comprising a bundle of filaments with a linear density of less than 0.8 dtex, a g-value higher than 2.5 GPa, an elongation (EAB) higher than 3.4%, and a L002 value higher than 350 Å.

2. The filament yarn of claim 1 wherein the filament linear density is in the range of 0.3 to less than 0.8 dtex.

3. The filament yarn of claim 2 wherein the filament linear density is in the range of 0.35 to 0.6 dtex.

4. The filament yarn of claim 1 wherein the g-value is higher than 2.6 GPa.

5. The filament yarn of claim 4 wherein the g-value is higher than 2.7 GPa.

6. The filament yarn of claim 1 wherein the L002 value is higher than 375 Å.

7. The filament yarn of claim 6 wherein the L002 value is higher than 400 Å.

8. A multifilament yarn assembled from at least two non-assembled filament yarns of claim 1.

* * * * *